US008135326B2

(12) United States Patent
Ohno et al.

(10) Patent No.: US 8,135,326 B2
(45) Date of Patent: Mar. 13, 2012

(54) IMAGE FORMING APPARATUS

(75) Inventors: Shigeo Ohno, Ebina (JP); Tomoya Ichikawa, Ebina (JP); Yoji Yamaguchi, Ebina (JP); Kuniaki Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 409 days.

(21) Appl. No.: 12/465,382

(22) Filed: May 13, 2009

(65) Prior Publication Data

US 2010/0074634 A1 Mar. 25, 2010

(30) Foreign Application Priority Data

Sep. 22, 2008 (JP) ..... 2008-242639
Jan. 22, 2009 (JP) ..... 2009-012053

(51) Int. Cl.
*G03G 21/00* (2006.01)

(52) U.S. Cl. ..... 399/346; 399/38; 399/349; 184/17

(58) Field of Classification Search ..... 399/9, 38, 399/44, 75, 127, 343, 346, 349; 184/15.1, 184/17, 99

See application file for complete search history.

(56) References Cited

U.S. PATENT DOCUMENTS

| | | | | |
|---|---|---|---|---|
| 5,365,316 | A | 11/1994 | Motoyama et al. | 355/219 |
| 5,444,519 | A | 8/1995 | Motoyama et al. | 355/219 |
| 6,330,420 | B1 * | 12/2001 | Honda | 399/346 |
| 7,430,377 | B2 | 9/2008 | Koike et al. | 399/12 |
| 7,725,069 | B2 | 5/2010 | Kawahara et al. | 399/346 |
| 2002/0037187 | A1 * | 3/2002 | Kai et al. | 399/346 |
| 2004/0091276 | A1 * | 5/2004 | Yoshida et al. | 399/38 |
| 2005/0084271 | A1 * | 4/2005 | Koike et al. | 399/12 |
| 2007/0258743 | A1 * | 11/2007 | Shakuto et al. | 399/346 |
| 2008/0063447 | A1 | 3/2008 | Kawahara et al. | 399/346 |

FOREIGN PATENT DOCUMENTS

| | | |
|---|---|---|
| JP | 5-224565 | 9/1993 |
| JP | 05-297672 | 11/1993 |
| JP | 06-194908 | 7/1994 |
| JP | 2000-350469 | 12/2000 |
| JP | 2002-296996 | 10/2002 |
| JP | 2004-117458 | 4/2004 |
| JP | 2004-226685 | 8/2004 |
| JP | 2005-003808 | 1/2005 |
| JP | 2005-070274 | 3/2005 |
| JP | 2008-096948 | 4/2008 |
| JP | 2008-146013 | 6/2008 |
| JP | 2008-216345 | 9/2008 |

* cited by examiner

*Primary Examiner* — David Porta
*Assistant Examiner* — Benjamin Schmitt
(74) *Attorney, Agent, or Firm* — Morgan, Lewis & Bockius LLP

(57) ABSTRACT

An image forming apparatus includes a developer housing that holds a developer; a lubricant supply brush that rotates when in contact with the developer housing, and that supplies a lubricant to a surface of the developer housing; a lubricant that is in contact with the lubricant supply brush; a first voltage supply unit that supplies an AC voltage on which a DC voltage is superimposed to the lubricant supply brush; a determination unit that determines whether or not a usage state of the developer housing is a state at an initial stage; and a controller that controls the first voltage supply unit to supply the AC voltage on which the DC voltage is superimposed to the lubricant supply brush, prior to start of execution of an image forming operation if the determination unit determines that the usage state of the developer housing is the state at the initial stage.

12 Claims, 14 Drawing Sheets

| | 10°C OR LOWER | 11°C TO 20°C | 21°C TO 30°C |
|---|---|---|---|
| 10% RH OR LOWER | | | |
| 30% RH OR LOWER | | | |
| 50% RH OR LOWER | | | |
| 70% RH OR LOWER | | | |
| 90% RH OR LOWER | | | |

Fig. 12

IMAGE FORMING APPARATUS

CROSS-REFERENCE TO RELATED APPLICATIONS

This application is based on and claims priority under 35 USC 119 from Japanese Patent Application No. 2008-242639 filed on Sep. 22, 2008 and Japanese Patent Application No. 2009-012053 filed on Jan. 22, 2009.

BACKGROUND

The present invention relates to an image forming apparatus.

SUMMARY

According to an aspect of the invention, there is provided an image forming apparatus including:

a image carrier that holds a developer;

a lubricant supply brush that rotates when in contact with the image carrier, and that supplies a lubricant to a surface of the image carrier;

a lubricant that is in contact with the lubricant supply brush;

a first voltage supply unit that supplies an AC voltage on which a DC voltage is superimposed to the lubricant supply brush;

a determination unit that determines whether or not a usage state of the image carrier is a state at an initial stage; and a controller that controls the first voltage supply unit to supply the AC voltage on which the DC voltage is superimposed to the lubricant supply brush prior to start of execution of an image forming operation if the determination unit determines that the usage state of the image carrier is the state at the initial stage.

BRIEF DESCRIPTION OF THE DRAWINGS

Exemplary embodiments of the present invention will be described in detail based on the following figures, wherein:

FIG. 12 shows an environment table;

DETAILED DESCRIPTION

A description will be given below of exemplary embodiments according to the present invention.

Figure 1:
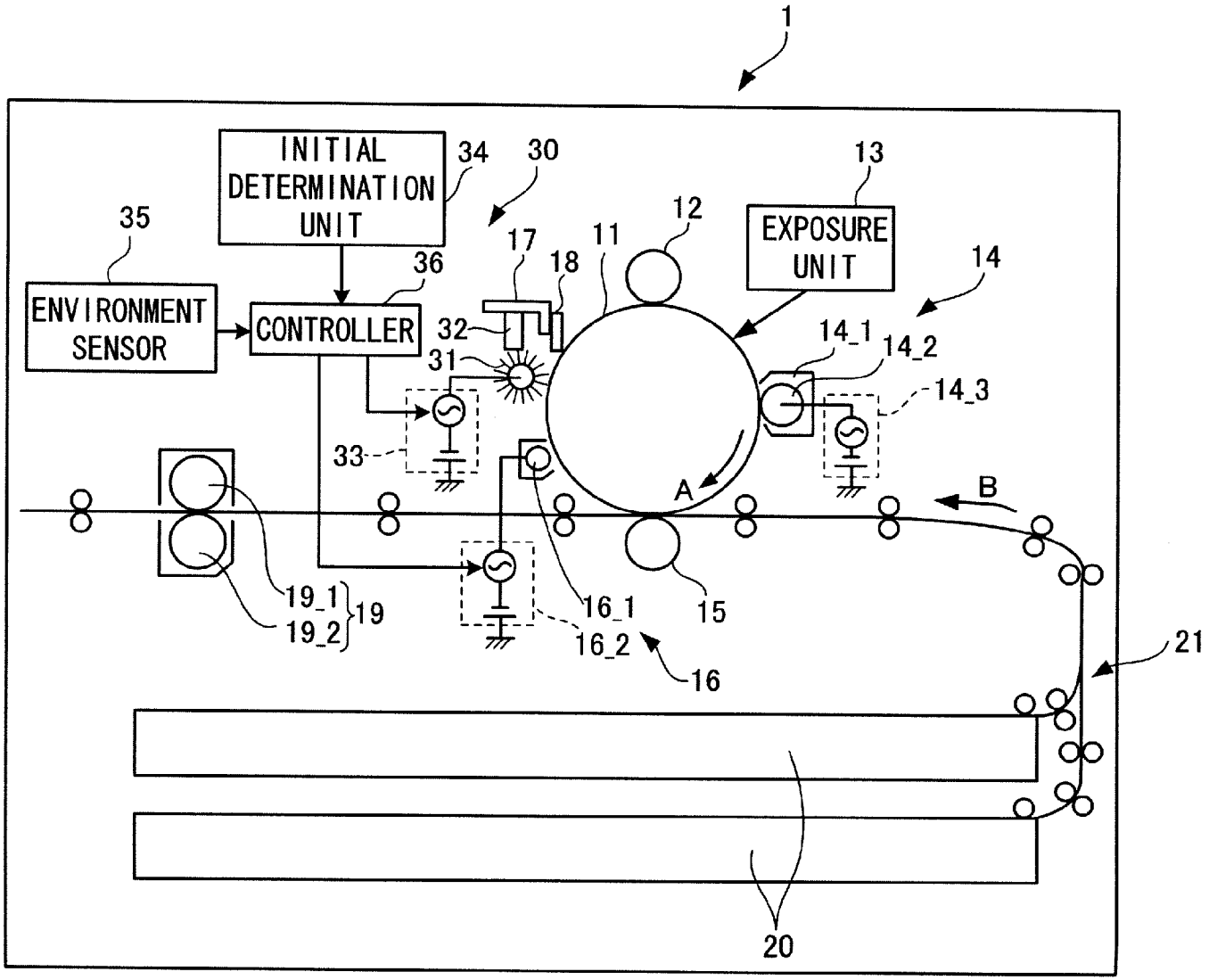
FIG. 1 is a schematic configuration diagram of a printer that is one example of an image forming apparatus according to an exemplary embodiment of the present invention.

FIG. 1 is a schematic configuration diagram of a printer that is one example of an image forming apparatus according to an exemplary embodiment of the present invention.

A printer 1 shown in FIG. 1 includes a photoreceptor 11 that rotates in a direction of an arrow A, as an example of a image carrier.

The printer 1 also includes a charger 12 charging the photoreceptor 11.

The printer 1 further includes an exposure unit 13 irradiating a light in a pattern according to an image signal onto the photoreceptor 11 charged by the charger 12 and forming an electrostatic latent image on the photoreceptor 11.

Moreover, the printer 1 includes a developing machine 14, which is an example of a developing unit, developing the electrostatic latent image formed on the photoreceptor 11 by the exposure unit 13 using toner and forming a toner image on the photoreceptor 11. This developing machine 14 includes a developer reservoir 14_1, a developing roll 14_2 and a developing voltage supply unit 14_3, which is an example of a third voltage supply unit. A two-component developer including toner containing external additive fine particles and a magnetic carrier is accommodated in the developer reservoir 14_1. The developing roll 14_2, which is arranged to be proximate to the photoreceptor 11, develops the electrostatic latent image by the toner contained in the developer on the photoreceptor 11 when an AC voltage, on which a DC voltage is superimposed, is supplied to the developing roll 14_2 from the developing voltage supply unit 14_3.

Moreover, the printer 1 includes a transfer roll 15 transferring a toner image formed on the photoreceptor 11 by the developing machine 14 onto a recording sheet that is an example of a recording target medium.

Further, the printer 1 includes a static eliminator 16 that is an example of a static elimination unit. This static eliminator 16 includes a erase lamp 16_1 and a charge-elimination voltage supply unit 16_2, which is an example of a second voltage supply unit. The erase lamp 16_1 eliminates charges of the photoreceptor 11 when the AC voltage, on which the DC voltage is superimposed, is supplied to the erase lamp 16_1 from the charge-elimination voltage supply unit 16_2.

The printer 1 further includes a cleaning member 18 supported by a support member 17. This cleaning member 18 is a member eliminating unwanted substances such as toner that cannot be moved onto the recording sheet in a transfer region, paper powder or corona products generated by electrification, from a surface of the photoreceptor 11 passing through the transfer region.

The printer 1 further includes a fixing unit 19 heating and pressurizing the toner image transferred onto the recording sheet by the transfer roll 15, thereby fixing the heated and pressurized toner image onto the recording sheet. This fixing unit 19 includes a fixing roll 19_1 including a heating mechanism and a pressure roll 19_2 provided to face the fixing roll 19_1.

The printer 1 also includes a recording sheet accommodation unit 20 in which recording sheets are accommodated, and a sheet transport unit 21 discharging a recording sheet from the recording sheet accommodation unit 20 and transporting the recording sheet to a preset transport path.

The printer 1 further includes a lubricant supply device 30. This lubricant supply device 30 is a device that supplies lubricant to the photoreceptor 11 before the printer 1 executes an image forming operation for fixing the toner image formed on the photoreceptor 11 onto the recording sheet. This lubricant supply device 30 includes a lubricant supply brush 31, solid lubricant 32, a brush voltage supply unit 33, an initial determination unit 34, an environment sensor 35 and a controller 36. A configuration of this lubricant supply device 30 is described later. The image forming operation executed by the printer 1 is first described schematically.

In the printer 1, the charger 12 charges a surface of the photoreceptor 11 from which charge has been eliminated by the static eliminator 16. The exposure unit 13 irradiates a light in a pattern according to an image signal onto the charged surface of the photoreceptor 11 to form an electrostatic latent image on the photoreceptor 11. This electrostatic latent image is developed by the toner contained in the developer accommodated in the developer reservoir 14_1 of the developing machine 14. The resultant toner image is transferred onto the recording sheet discharged from the recording sheet accommodation unit 20 by the sheet transport unit 21 and transported in a direction of an arrow B in the transfer region defined by the photoreceptor 11 and the transfer roll 15. The fixing unit 19 heats and pressurizes the toner image, thereby an image resulting from the toner image is formed on the recording sheet.

Furthermore, the cleaning member 18 eliminates the unwanted substances adhering onto the surface of the photoreceptor 11 passing through the transfer region, thus preparing for a next image forming operation.

The lubricant supply device 30 is described next.

The lubricant supply brush 31 constituting the lubricant supply device 30 is arranged downstream of the erase lamp 16_1 with respect to the photoreceptor 11. This lubricant supply brush 31 rotates when contacting with the photoreceptor 11.

The solid lubricant 32 is supported by the support member 17 in a state of being pressed against the lubricant supply brush 31. This solid lubricant 32 mainly contains zinc stearate. As the lubricant, PMMA-based lubricant or hydrophobized silica-based lubricant as well as the solid lubricant 32 mainly containing the zinc stearate may be used.

The brush voltage supply unit 33, which is one example of the first voltage supply unit, supplies the AC voltage on which the DC voltage is superimposed to the lubricant supply brush 31. More specifically, this brush voltage supply unit 33 supplies the AC voltage on which the DC voltage is superimposed, which is lower than a discharge start voltage for starting discharge between the lubricant supply brush 31 and the photoreceptor 11 to the lubricant supply brush 31 so as to prevent the discharge from being generated between the lubricant supply brush 31 and the photoreceptor 11.

The initial determination unit 34 is one example of a determination unit. In this case, the photoreceptor 11 is incorporated into a photosensitive unit and the photosensitive unit includes a storage unit (not shown) storing therein the number of times of use (hereinafter, "usage count") that is information indicating a usage state of the photoreceptor 11. The initial determination unit 34 reads the usage count of the photoreceptor 11 or the number of rotation cycles of the photoreceptor 11, and determines whether or not the usage state of the photoreceptor 11 is a state at an initial stage.

The environment sensor 35 detects an environment including a temperature and a humidity.

The controller 36, which is one example of a controller, controls the printer 1 to execute a lubricant supply operation for supplying the solid lubricant 32 to the photoreceptor 11 while controlling the brush voltage supply unit 33 to supply the AC voltage, on which the DC voltage is superimposed, to the lubricant supply brush 31 prior to start of executing the image forming operation if the initial determination unit 34 determines that the usage state of the photoreceptor 11 is the state at the initial stage and the environment sensor 35 detects a preset environment. By increasing the number of rotations of the lubricant supply brush 31 only when the photoreceptor 11 is in the state at the initial stage, time required for supplying the lubricant 32 to the photoreceptor 11 can be shortened. When the lubricant supply operation ends, the controller 36 returns the number of rotations of the lubricant supply brush 31 to an ordinary number of rotations set for the image forming operation so as to prevent abrasion of the photoreceptor 11 and the lubricant supply brush 31. Furthermore, a substantially linear relationship is held between the number of rotations of the lubricant supply brush 31 and a supply amount of the lubricant 32. Due to this, if the number of rotations of the lubricant supply brush 31 is, for example, doubled, then lubricant supply time is reduced approximately by half and the printer 1 can start printing at earlier time.

If the printer 1 is to execute the lubricant supply operation, the controller 36 controls the brush voltage supply unit 33 and the charge-elimination voltage supply unit 16_2 to supply AC voltages identical in frequency, phase and waveform, respectively so as to suppress a potential difference between the AC voltage supplied to the lubricant supply brush 31 and the AC voltage supplied to the erase lamp 16_1 to be small.

While the printer 1 is executing the lubricant supply operation, the controller 36 may control the charge-elimination voltage supply unit 16_2 to stop supplying the AC voltage to the erase lamp 16_1 so as to simplify control over the AC voltage between the lubricant supply brush 31 and the erase lamp 16_1 as compared with an instance of executing the image forming operation.

Furthermore, the controller 36 controls the brush voltage supply unit 33 and the charge-elimination voltage supply unit 16_2 to supply the AC voltages each at a frequency that is a specified fraction of an integer of a frequency of the AC voltage supplied to the developing roll 14_2 from the developing voltage supply unit 14_3, respectively. This thereby prevents the electrostatic latent image developed on the photoreceptor 11 from being disturbed by the AC voltages supplied to the lubricant supply brush 31 and the charge-elimination brush 16_1.

If the printer 1 does not include the lubricant supply device 30, a so-called ghost image to be described later often occurs onto the recording sheet.

Figure 2:
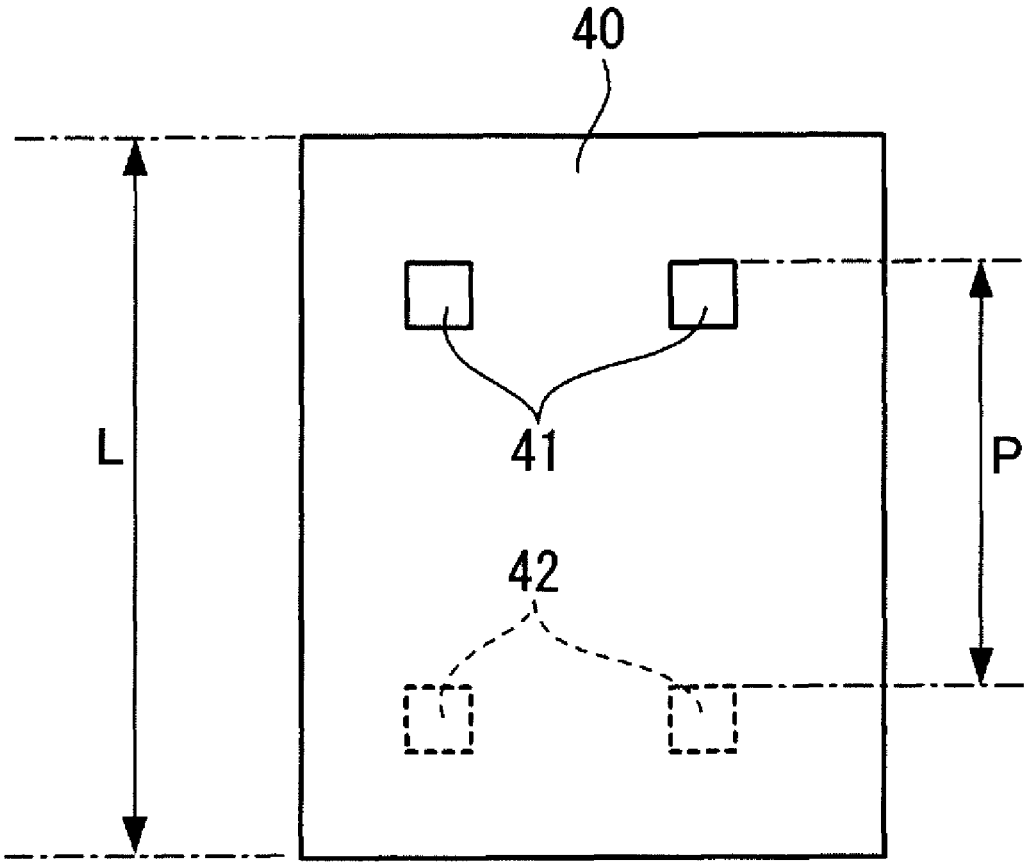
FIG. 2 is a schematic diagram showing an image formed on a recording sheet and a ghost image occurring to result from this image.

FIG. 2 is a schematic diagram showing an image formed on the recording sheet and a ghost image occurring to result from this image.

FIG. 2 shows an image 41 formed on a recording sheet 40 and a ghost image 42 resulting from the image 41. In FIG. 2, symbols L and P denote a longitudinal dimension of the recording sheet 40 and a pitch of one turn of the photoreceptor 11, respectively. Furthermore, the L and P satisfy a relationship of L>P.

It is assumed herein that a printer that does not include the lubricant supply device 30 continuously prints the image 41 shown in FIG. 2 on plural recording sheets 40. First, the image 41 is formed on a first recording sheet 40 by a first turn of the photoreceptor 11. Next, the photoreceptor 11 makes another turn to form the image 41 on a second recording sheet 40. As a result, the ghost image 42 resulting from the image 41 occurs to a rear end of the first recording sheet 40. A mechanism of occurrence of the ghost image 42 is described with reference to FIG. 3.

Figure 3:
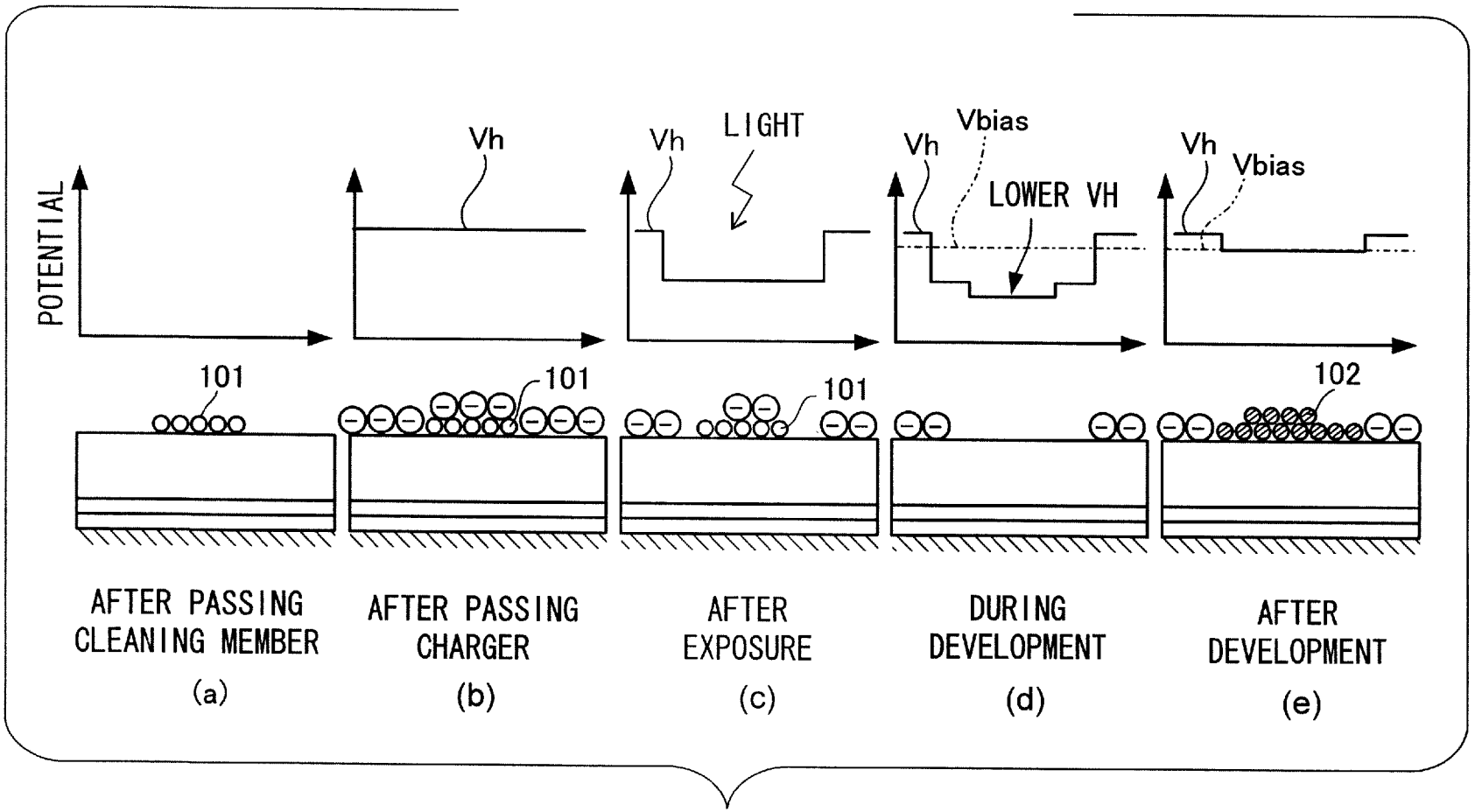
FIG. 3 is a schematic diagram explaining a mechanism of occurrence of a ghost image.

FIG. 3 is a schematic diagram explaining a mechanism of occurrence of a ghost image.

Part (a) of FIG. 3 shows the surface of the photoreceptor 11 after passing through the cleaning member 18 after end of a previous image forming operation. External additive fine particles 101 slipping through the cleaning member 18 adhere onto the surface of the photoreceptor 11.

In this case, before performing a current image forming operation, the charger 12 charges the surface of the photoreceptor 11.

Part (b) of FIG. 3 shows the surface of the photoreceptor 11 after passing through the charger 12. The surface of the photoreceptor 11 is charged with a charged potential Vh having a negative polarity in a state of adhering of the external additive fine particles 101 onto the surface thereof. Furthermore, the exposure unit 13 irradiates the photoreceptor 11 with light.

Part (c) of FIG. 3 shows the surface of the photoreceptor 11 after exposure. External additive fine particles 101 charged with the charged potential having the negative polarity adhere onto the surface of the photoreceptor 11 after the exposure.

Moreover, the surface of the photoreceptor 11 is moved to the developing region defined by the photoreceptor 11 and the developing machine 14. In this developing region, the external additive fine particles 101 charged with the charged potential having the negative polarity are eliminated.

Part (d) of FIG. 3 shows the surface of the photoreceptor 11 in a state in which the external additive fine particles are eliminated in the developing region. In the developing region, the external additive fine particles adhering onto the surface of the photoreceptor 11 are eliminated by a bias voltage Vbias applied from the developing machine 14. Portions of the surface of this photoreceptor 11 onto which portions the external additive fine particles adhere are lower in potential Vh than portions thereof onto which portions no external additive fine particles adhere. Next, the photoreceptor 11 is developed by toner 102.

Part (e) of FIG. 3 shows the surface of the photoreceptor 11 after development. The portions of the surface of this photoreceptor 11 which portions are lower in the potential Vh (onto which portions the external additive fine particles adhere) are developed by the toner 102. In this way, the ghost image 42 shown in FIG. 2 occurs.

The printer 1 according to this exemplary embodiment includes the lubricant supply device 30 supplying the solid lubricant 32 to the photoreceptor 11. This solid lubricant 32 has a high affinity for the external additive fine particles 101. In this case, if the lubricant supply brush 31 to which the AC voltage is supplied with the superimposed DC voltage from the brush voltage supply unit 33 shown in FIG. 1, supplies the solid lubricant 32 to the surface of the photoreceptor 11, the external additive fine particles 101 adhere to the solid lubricant 32 so as to be enclosed with the solid lubricant 32. This can reduce an amount of the external additive fine particles 101 slipping through the cleaning member 18. Accordingly, occurrence of the ghost image 42 is suppressed, as described next in detail.

At an initial usage stage, the surface of the photoreceptor 11 is in a state in which the solid lubricant 32 is not supplied to the surface thereof. In this exemplary embodiment, the initial determination unit 34 determines whether or not the usage stage of the photoreceptor 11 is the state at the initial stage. More specifically, the initial determination unit 34 reads the usage count of the photoreceptor 11 from the storage unit included in the photosensitive unit and determines whether or not the usage state of the photoreceptor 11 is the state at the initial stage.

If the initial determination unit 34 determines that the usage stage of the photoreceptor 11 is the state at the initial stage and the environment sensor 35 detects the preset environment, the printer 1 executes, prior to start executing the image forming operation, the lubricant supply operation for supplying the solid lubricant 32 to the photoreceptor 11 while controlling the brush voltage supply unit 33 to supply the AC voltage, on which the DC voltage is superimposed, to the lubricant supply brush 31. The relationship between an AC voltage supplied to the lubricant supply brush 31 and a ghost image is described.

Figure 4:
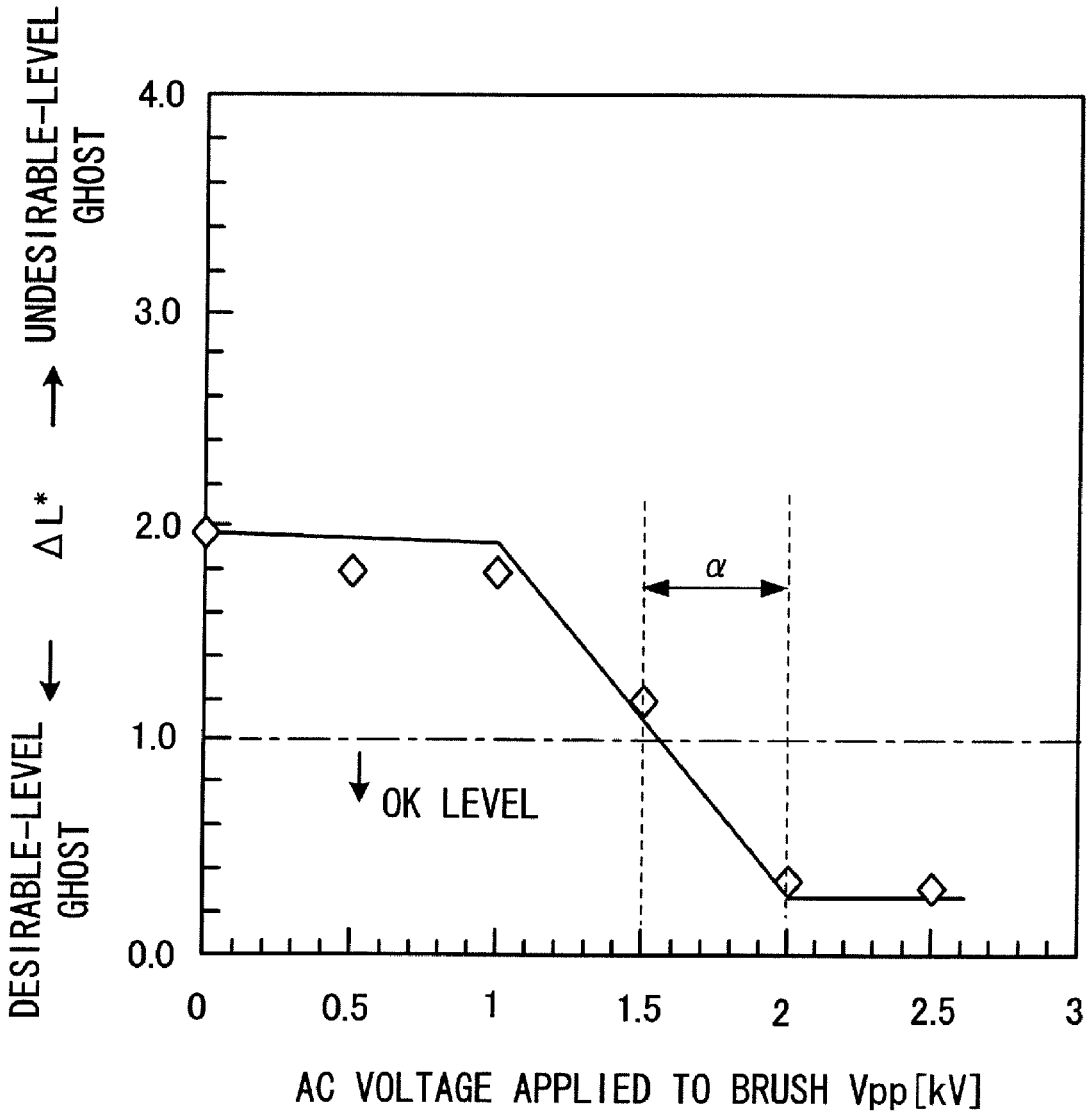
FIG. 4 is a graph showing the relationship between an AC voltage supplied to a lubricant supply brush and a ghost image.

FIG. 4 is a graph showing the relationship between an AC voltage supplied to the lubricant supply brush 31 and a ghost image.

A horizontal axis of FIG. 4 indicates a magnitude of an AC voltage Vpp supplied to the lubricant supply brush 31. A vertical axis thereof indicates a lightness difference $\Delta L^*$ between the ghost image 42 shown in FIG. 2 and a portion of the recording sheet 40 which portion is adjacent to the ghost image 42.

If the AC voltage Vpp supplied to the lubricant supply brush 31 is in a range of 0 kV to 1.5 kV, supply of the solid lubricant 32 from the lubricant supply brush 31 to the photoreceptor 11 is small in amount. Due to this, the amount of the external additive fine particles 101 slipping through the cleaning member 18 is large and many external additive fine particles 101 adhere onto the surface of the photoreceptor 11. Therefore, the lightness difference $\Delta L^*$ between the ghost image 42 formed on the recording sheet 40, shown in FIG. 2 and the portion of the recording sheet 40 which portion is adjacent to the ghost image 42 is as great as 2.0 to 1.1 and it is determined that the ghost image 42 is at an undesirable level.

On the other hand, if the AC voltage Vpp supplied to the lubricant supply brush 31 is in a range a from 1.5 kV to 2.0 kV, supply of the solid lubricant 32 from the lubricant supply brush 31 to the photoreceptor 11 is large in amount. Due to this, the amount of the external additive fine particles 101 slipping through the cleaning member 18 is small and an amount of the external additive fine particles 101 adhering onto the surface of the photoreceptor 11 is small. Therefore, the lightness difference $\Delta L^*$ is as small as 1.0 to 0.2 and it is determined that the ghost image 42 is at a desirable level. It is to be noted that discharge possibly occurs if the AC voltage Vpp exceeds 2.0 kV. If discharge occurs, so-called image deletion possibly occurs. Therefore, the AC voltage Vpp supplied to the lubricant supply brush 31 may fall in a range a from 1.5 kV to 2.0 kV. A level of the ghost image 42, that is, ghost level changes according to an addition amount of the external additive fine particles contained in the toner. Due to this, if the ghost level is low, the AC voltage Vpp may be set smaller than 1.5 kV or the magnitude of the AC voltage Vpp may be appropriately changed so as to reduce discharge stress.

Figure 5:
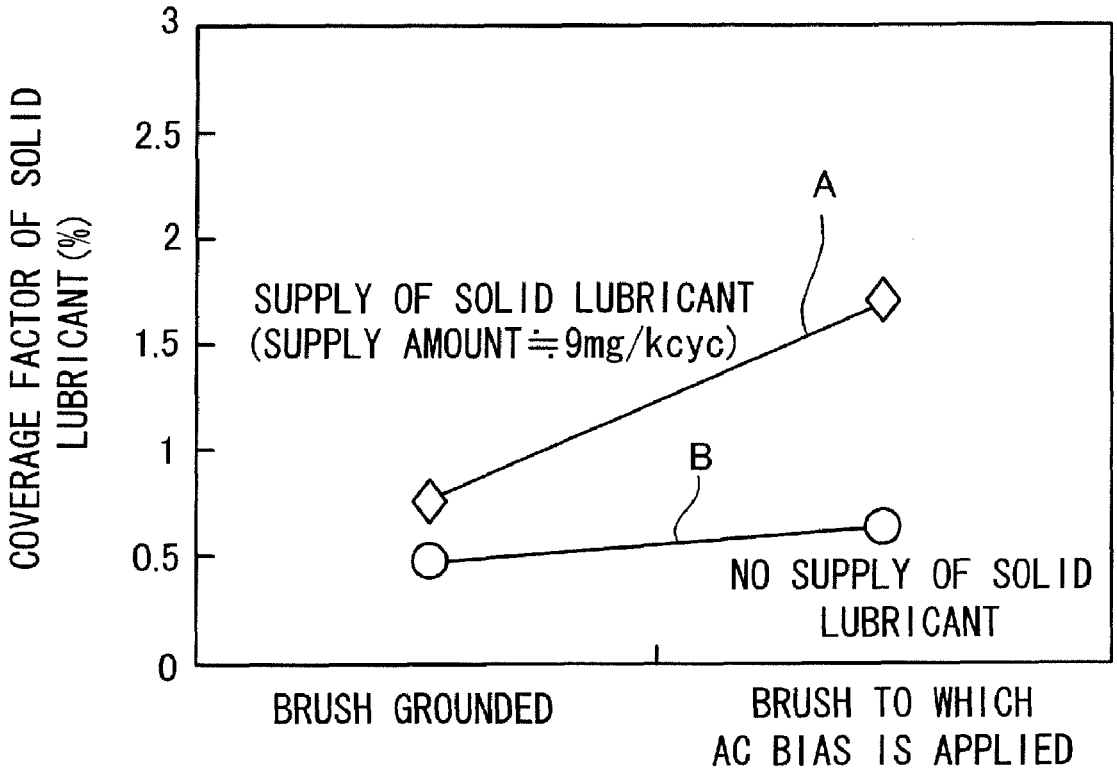
FIG. 5 is a graph showing the relationship between the AC voltage supplied to the lubricant supply brush and a coverage factor of a solid lubricant by which the solid lubricant covers a photoreceptor.

FIG. 5 is a graph showing the relationship between the AC voltage supplied to the lubricant supply brush 31 and a coverage factor of the solid lubricant 32 by which the solid lubricant covers the photoreceptor 11.

A horizontal axis of FIG. 5 indicates the magnitude of the AC voltage Vpp supplied to the lubricant supply brush 31. A vertical axis thereof indicates the coverage factor of the solid lubricant 32 by which the solid lubricant 32 covers the photoreceptor 11. In FIG. 5, a graph A indicates the coverage factor if the solid lubricant 32 is supplied onto the photoreceptor 11 (in a supply amount of approximately 9 mg/kcyc (1000 rotations)) and the magnitude of the AC voltage Vpp changes from 0 kV (ground potential) to 2.0 kV. A graph B indicates the coverage factor if the magnitude of the AC voltage Vpp changes from 0 kV to 2.0 kV in a state in which no solid lubricant 32 is supplied onto the photoreceptor 11.

As indicated by the graph A, the coverage factor is as high as 0.7% to 1.5% if the solid lubricant 32 is supplied onto the photoreceptor 11 and the magnitude of the AC voltage Vpp changes from 0 kV to 2.0 kV.

As indicated by the graph B, the coverage factor is as low as 0.5% to 0.6% if the magnitude of the AC voltage Vpp changes from 0 kV to 2.0 kV in the state in which no solid lubricant 32 is supplied onto the photoreceptor 11.

Figure 6:
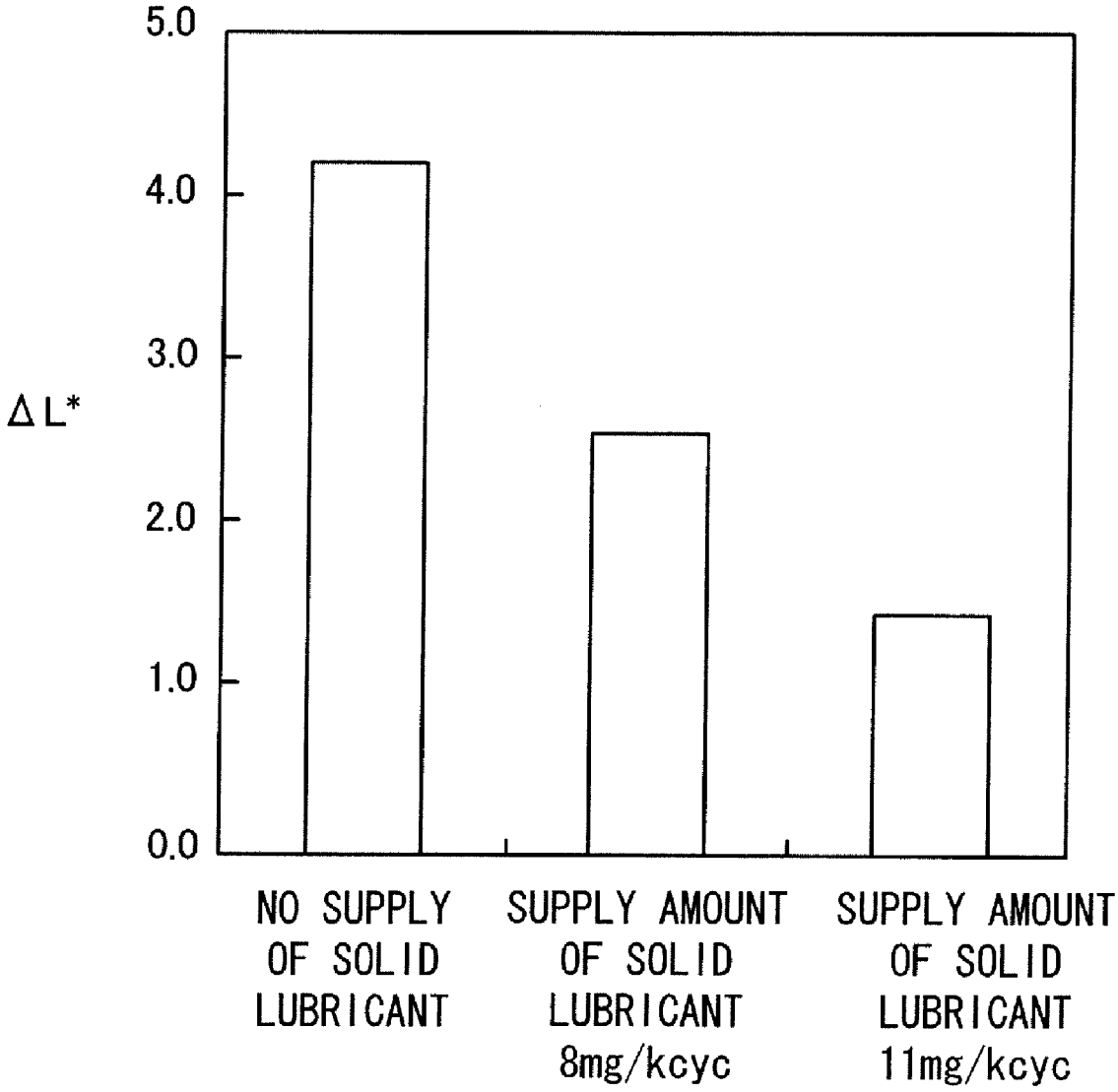
FIG. 6 is a graph showing the relationship between the supply amount of the solid lubricant and the lightness difference ΔL*.

FIG. 6 is a graph showing the relationship between the supply amount of the solid lubricant 32 and the lightness difference ΔL*.

As shown in FIG. 6, if no solid lubricant 32 is supplied onto the photoreceptor 11, the lightness difference ΔL* is great, that is, equal to or greater than 4.0. If the supply amount of the solid lubricant 32 is 8 mg/kcyc, the lightness difference ΔL* is approximately 2.5. Further, if the supply amount of the solid lubricant 32 is 11 mg/kcyc, the lightness difference ΔL* is approximately 1.5. In this way, if the supply amount of the solid lubricant 32 onto the photoreceptor 11 is larger, the lightness difference ΔL* is smaller and the ghost image nears the desirable level. In this case, the supply amount of the solid lubricant 32 is decided according to a force (load) by which the lubricant supply brush 31 is pressed against the solid lubricant 32.

Figure 7:
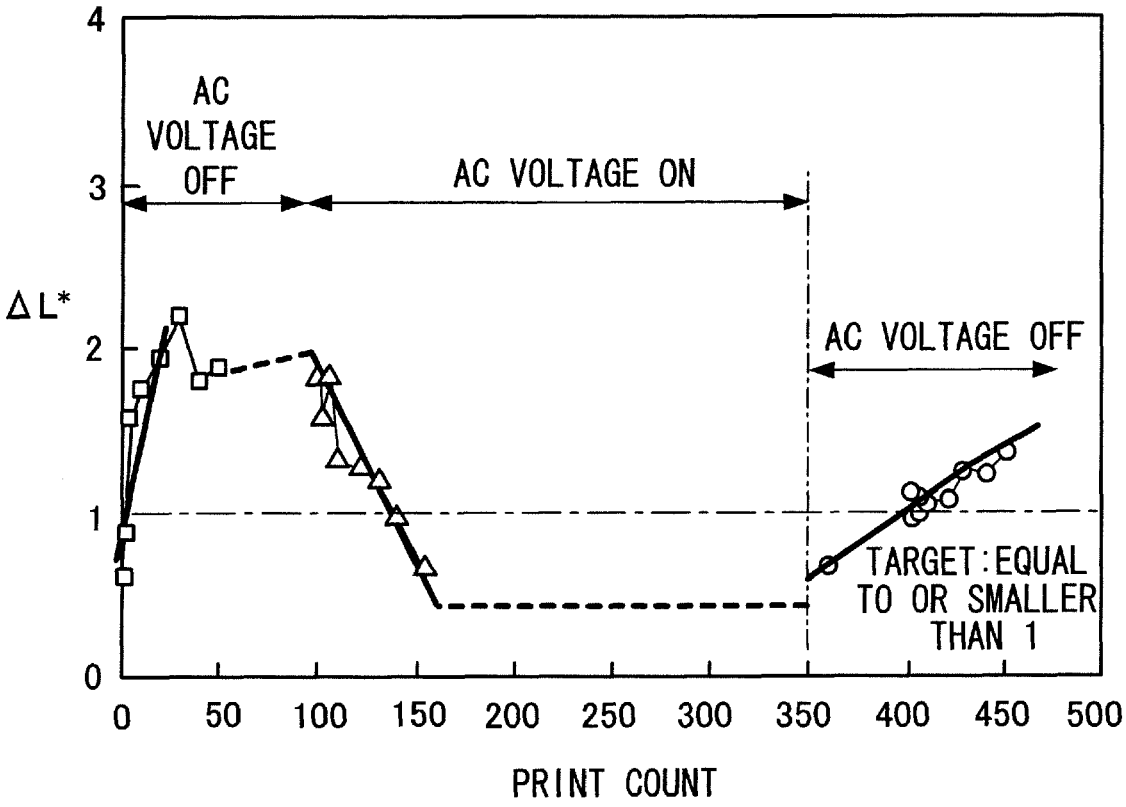
FIG. 7 is a graph showing the relationship between the number of prints (hereinafter, "print count") and the lightness difference ΔL* while the AC voltage to be supplied to the lubricant supply brush is turned on or off and the solid lubricant is supplied onto the photoreceptor.

FIG. 7 is a graph showing the relationship between the number of prints (hereinafter, "print count") and the lightness difference ΔL* while the AC voltage to be supplied to the lubricant supply brush 31 is turned on or off and the solid lubricant 32 is supplied onto the photoreceptor 11.

First, $0^{th}$ to $100^{th}$ prints are obtained and the print count reaches 100 while the AC voltage to be supplied to the lubricant supply brush 31 is turned off, that is, set into an OFF-state and the solid lubricant 32 is supplied onto the photoreceptor 11. As a result, at timing at which a few recording sheets are printed, the lightness difference ΔL* exceeds a target lightness difference (equal to or smaller than 1.0) at which the ghost image 42 is determined to be at the desirable level. Thereafter, the lightness difference ΔL* varies near a value twice as great as the target lightness difference.

Next, $101^{st}$ to $350^{th}$ prints are obtained and the print count reaches 350 while the AC voltage to be supplied to the lubricant supply brush 31 is changed from the OFF-state to an ON-state and the solid lubricant 32 is supplied onto the photoreceptor 11. As a result, the lightness difference ΔL* gradually falls, reaches the target level of 1.0 when the print count nears 140 and becomes stable at around 0.5 after the print count is equal to or larger than 160.

Moreover, $351^{st}$ to $470^{th}$ prints are obtained and the print count reaches 470 while the AC voltage to be supplied to the lubricant supply brush 31 is changed from the ON-state to an OFF-state and the solid lubricant 32 is supplied onto the photoreceptor 11. As a result, the lightness difference ΔL* gradually rises and exceeds the target level of 1.0 when the print count nears 400.

As obvious from the graph of FIG. 7, if the printer 1 performs the image forming operation while the AC voltage to be supplied to the lubricant supply brush 31 is turned on and the solid lubricant 32 is supplied onto the photoreceptor 11, the lightness difference ΔL* is kept equal to the target level. Accordingly, the ghost image becomes the desirable level.

Figure 8:
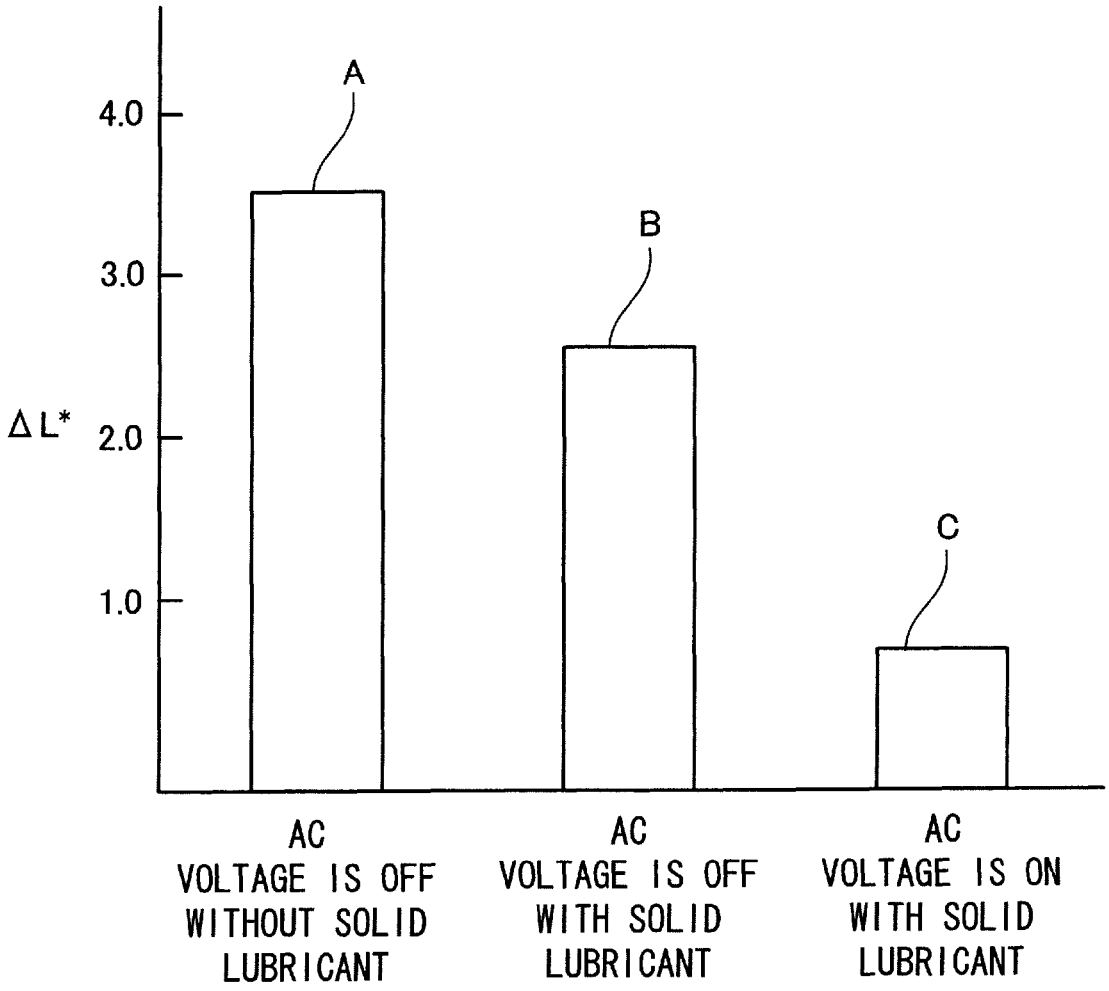
FIG. 8 is a graph showing the relationship between a combination of whether or not the AC voltage is supplied to the lubricant supply brush and whether or nor the solid lubricant is supplied onto the photoreceptor and the lightness difference ΔL*.

FIG. 8 is a graph showing the relationship between a combination of whether or not the AC voltage is supplied to the lubricant supply brush 31 and whether or nor the solid lubricant 32 is supplied onto the photoreceptor 11 and the lightness difference ΔL*.

A graph A shown in FIG. 8 indicates a magnitude of the lightness difference ΔL* after the print count reaches 50 while the AC voltage to be supplied to the lubricant supply brush 31 is turned off and the solid lubricant 32 is not supplied onto the photoreceptor 11. If neither the AC voltage is supplied to the lubricant supply brush 31 nor the solid lubricant 32 is supplied onto the photoreceptor 11, the lightness difference ΔL* is as great as 3.5.

A graph B shown in FIG. 8 indicates the magnitude of the lightness difference ΔL* after the print count reaches 50 while the AC voltage to be supplied to the lubricant supply brush 31 is turned off and the solid lubricant 32 is supplied onto the photoreceptor 11. In this case, the lightness difference ΔL* is still as great as 2.5.

A graph C shown in FIG. 8 indicates the magnitude of the lightness difference ΔL* after the print count reaches 50 while the AC voltage to be supplied to the lubricant supply brush 31 is turned on and the solid lubricant 32 is supplied onto the photoreceptor 11. In this case, the lightness difference ΔL* is as small as 0.5 and, therefore, sufficiently lower than the target lightness difference. The printer 1 according to this exemplary embodiment attains the lightness difference ΔL* equal to or smaller than 0.5 as indicated by the graph C.

Figure 9:
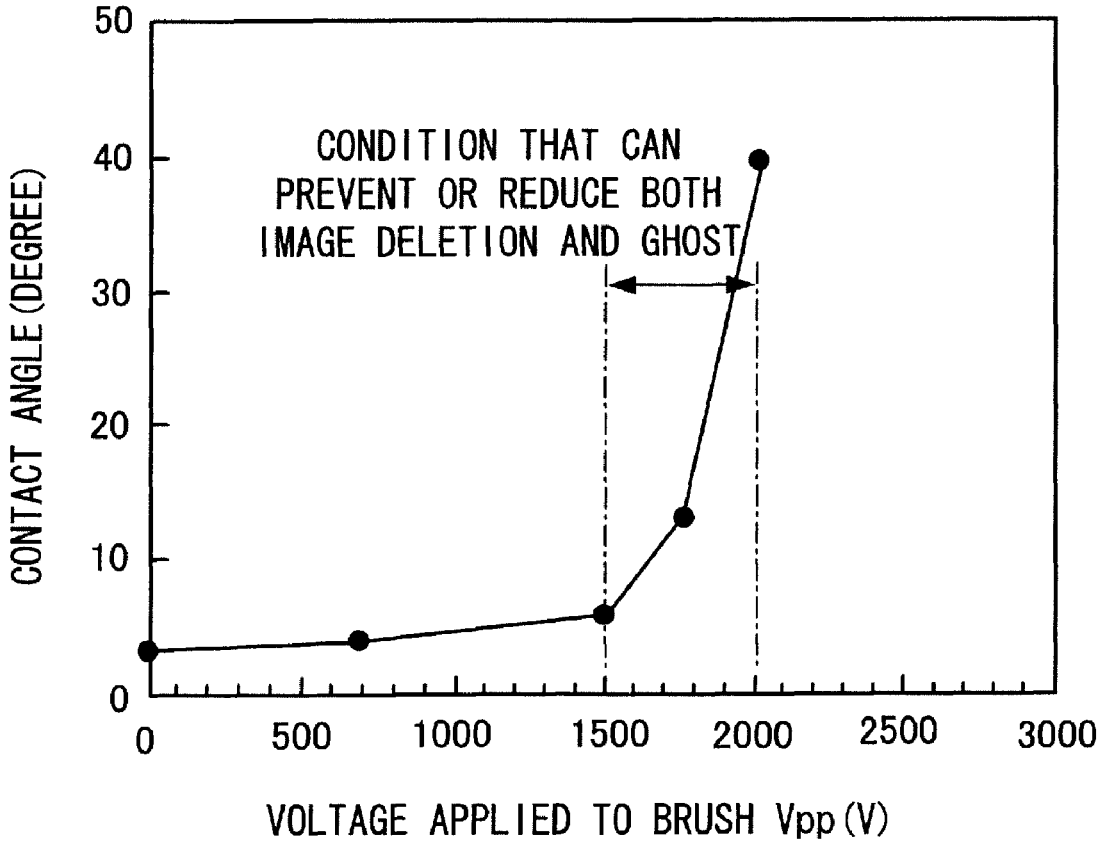
FIG. 9 is a graph showing the relationship between the AC voltage supplied to the lubricant supply brush and a contact angle of the photoreceptor with respect to the cleaning member.

FIG. 9 is a graph showing the relationship between the AC voltage supplied to the lubricant supply brush 31 and a contact angle of the photoreceptor 11 with respect to the cleaning member 18.

A horizontal axis of FIG. 9 indicates the magnitude of the AC voltage Vpp supplied to the lubricant supply brush 31. A vertical axis thereof indicates the contact angle of the photoreceptor 11 with respect to the cleaning member 18.

If the AC voltage Vpp supplied to the lubricant supply brush 31 is in the range of 0 kV to 1.5 kV, there is no probability of discharge and, therefore, the image deletion does not occur. Furthermore, if the contact angle of the photoreceptor 11 with respect to the cleaning member 18 is in a range less than five degrees, a frictional force generated between the photoreceptor 11 and the cleaning member 18 is low. Due to this, there is no probability that the cleaning member 18 vibrates to produce noise (blade noise). However, if the AC voltage Vpp is in the range of 0 kV to 1.5 kV, the supply amount of the solid lubricant 32 from the lubricant supply brush 31 to the photoreceptor 11 is small. Further, if the contact angle is in the range less than five degrees, the amount of the external additive fine particles slipping through the cleaning member 18 is large. Accordingly, the ghost image tends to occur.

If the AC voltage Vpp supplied to the lubricant supply brush 31 is in the range of 1.5 kV to 2.0 kV and the contact angle of the photoreceptor 11 with respect to the cleaning member 18 is in a range of 5 degrees to 25 degrees, there is no probability of discharge and the frictional force generated between the photoreceptor 11 and the cleaning member 18 is low. In this case, if the AC voltage Vpp is in the range of 1.5 kV to 2.0 kV, the supply amount of the solid lubricant 32 from the lubricant supply brush 31 to the photoreceptor 11 is large. Further, if the contact angle is in the range of 5 degrees to 25 degrees, the amount of the external additive fine particles slipping through the cleaning member 18 is small. Accordingly, the probability of occurrence of the ghost image is low. Therefore, the AC voltage Vpp may be set in the range of 1.5 kV to 2.0 kV and the contact angle of the photoreceptor 11 with respect to the cleaning member 18 may be set in the range of 5 degrees to 25 degrees.

Figure 10:
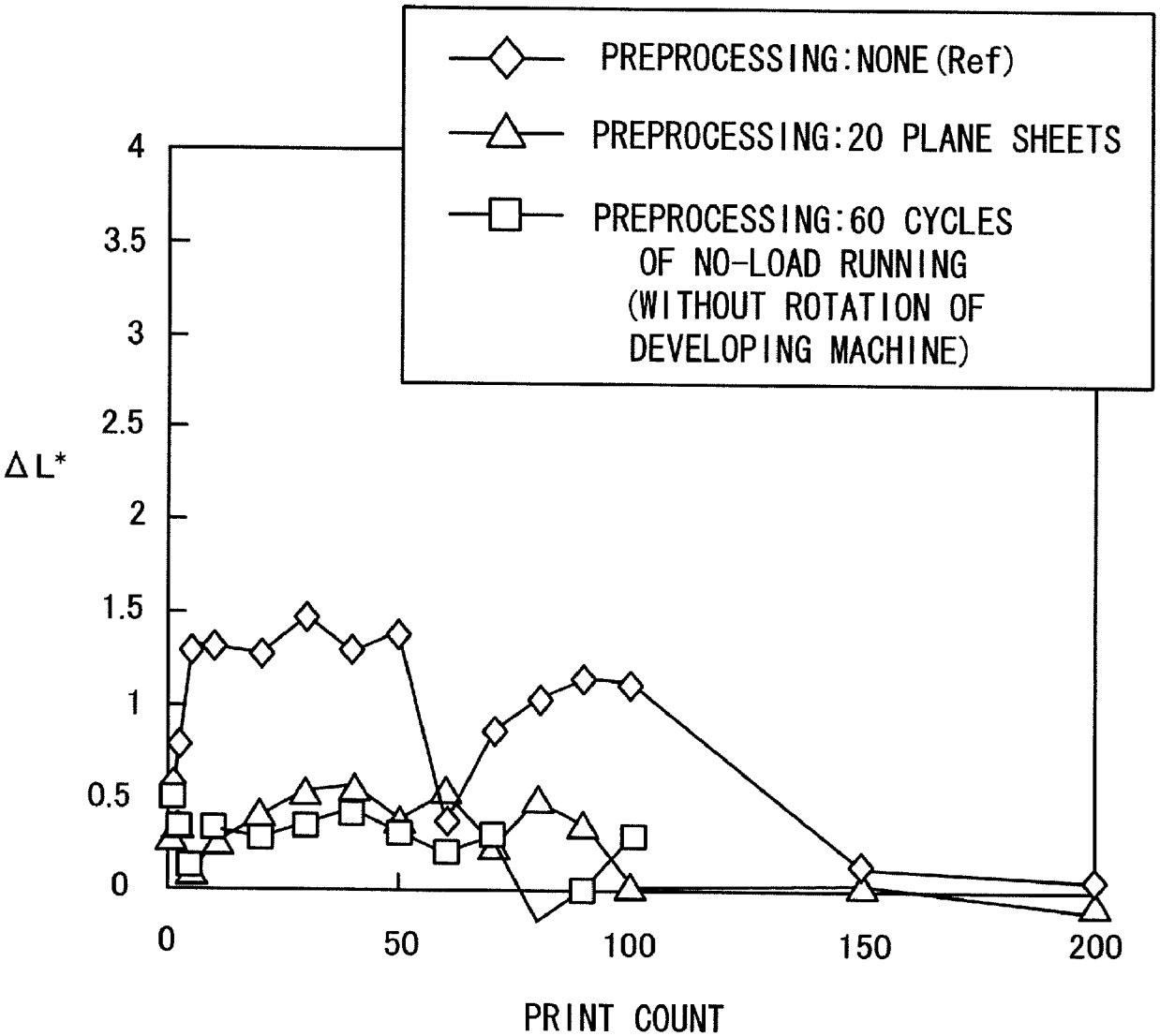
FIG. 10 is a graph showing the relationship between the print count and the lightness difference ΔL* if the printer does not execute the lubricant supply operation and that if the printer executes the lubricant supply operation.

FIG. 10 is a graph showing the relationship between the print count and the lightness difference ΔL* if the printer 1 does not execute the lubricant supply operation and that if the printer 1 executes the lubricant supply operation.

If the printer 1 does not execute the lubricant supply operation (preprocessing) but executes the image forming operation to obtain the $0^{th}$ to $200^{th}$ prints, the lightness difference ΔL* exceeds the target lightness difference equal to or smaller than 1.0 at the initial stage from the $0^{th}$ to $50^{th}$ prints.

If the printer 1 uses 20 plane sheets, executes the lubricant supply operation (preprocessing) and then executes the image forming operation to obtain the $0^{th}$ to $200^{th}$ prints, the lightness difference ΔL* does not exceed the target lightness difference equal to or smaller than 1.0 for all the $0^{th}$ to $200^{th}$ prints.

Moreover, if the printer 1 executes the lubricant supply operation (preprocessing) by causing the photoreceptor 11 to make no-load running 60 times (without rotation of the developing machine 14) and then executes the image forming operation to obtain the $0^{th}$ to $200^{th}$ prints, the lightness difference ΔL* does not exceed the target lightness difference equal to or smaller than 1.0 for all the $0^{th}$ to $200^{th}$ prints.

Figure 11:
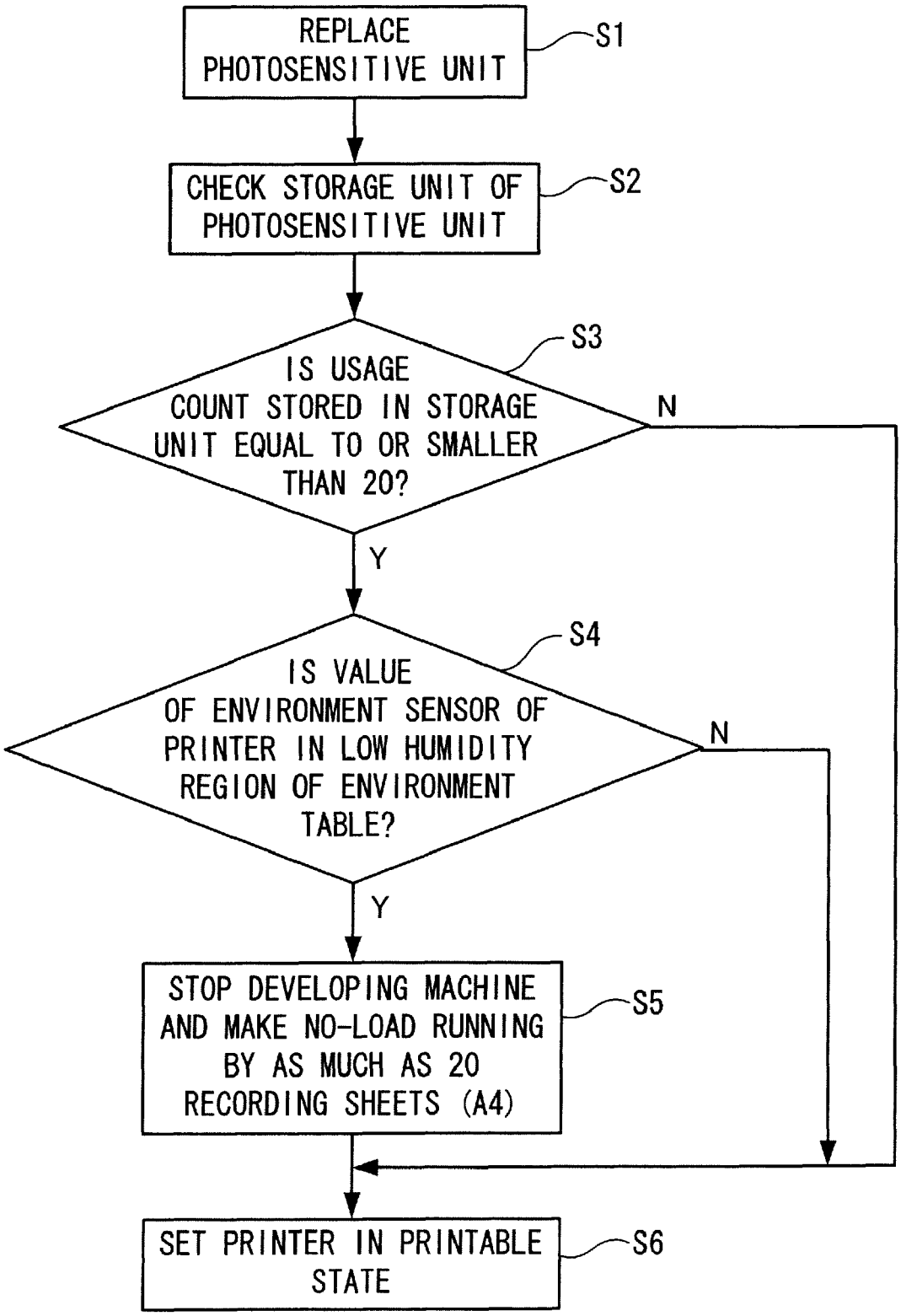
FIG. 11 is a flowchart showing a flow of a processing routine executed if the photosensitive unit is replaced in the printer shown in FIG. 1.

FIG. 11 is a flowchart showing a flow of a processing routine executed if the photosensitive unit is replaced in the printer 1 shown in FIG. 1.

In step S1, first, the photosensitive unit is replaced by another photosensitive unit.

In step S2, the storage unit included in the photosensitive unit is checked. More specifically, the initial determination unit 34 reads the usage count of the photoreceptor 11 recorded in the storage unit.

In step S3, the initial determination unit 34 determines whether or not the usage count of the photoreceptor 11 recorded in the storage unit is equal to or smaller than 20. If the initial determination unit 34 determines that the usage count exceeds 20, the usage state of the photoreceptor 11 is not the state at the initial stage. Accordingly, a processing goes to step S6. If the initial determination unit 34 determines that the usage count is equal to or smaller than 20, the usage state of the photoreceptor 11 is the state at the initial stage. Accordingly, the processing goes to step S4.

In the step S4, it is determined whether or not a value detected by the environment sensor 35 included in this printer 1 (a value indicating the environment including the temperature and the humidity) is in a low humidity region of an environment table shown below. The environment table is described.

FIG. 12 shows the environment table.

The environment table shown in FIG. 12 is provided in the controller 36. The low humidity region covers a region at a temperature equal to or lower than 10° C. and a humidity RH equal to or lower than 30%, a region at the temperature in a range of 11° C. to 20° C. and the humidity RH equal to or lower than 30% and a region at the temperature in a range of 21° C. to 30° C. and the humidity RH equal to or lower than 30% (shaded regions in FIG. 12). In this low humidity region, the ghost image tends to occur. Referring back to FIG. 11, the processing routine is described.

If it is determined that the value detected by the environment sensor 35 is not present in the low humidity region in the step S4, the probability of occurrence of the ghost image is low and the processing, therefore, goes to the step S6. If it is determined that the value detected by the environment sensor 35 is present in the low humidity region in the step S4, the probability of occurrence of the ghost image is high and the processing, therefore, goes to step S5.

In the step S5, the developing machine 14 is stopped and the photoreceptor 11 is caused to make no-load running by as much as 20 recording sheets of A4 size. The printer 1 thereby executes the lubricant supply operation. The processing goes to the step S6.

In the step S6, the printer 1 is in a printable state. Namely, the printer 1 is in a state of starting executing the image forming operation.

In this exemplary embodiment, an instance of the controller 36 to be described below is mentioned as the controller according to the present invention that exercises control while the usage stage of the image carrier is the state at the initial stage. Namely, this controller 36 controls the printer 1 to execute the lubricant supply operation if the initial determination unit 34 determines that the usage state of the photoreceptor 11 is the state at the initial stage and the environment sensor 35 detects the preset environment.

Furthermore, if the printer 1 is to execute the lubricant supply operation, the controller 36 controls the brush voltage supply unit 33 and the charge-elimination voltage supply unit 16_2 to supply the AC voltages identical in frequency, phase and waveform, respectively.

Moreover, the controller 36 controls the brush voltage supply unit 33 and the charge-elimination voltage supply unit 16_2 to supply the AC voltages each at the frequency that is the specified fraction of the integer of the frequency of the AC voltage supplied to the developing roll 14_2 from the developing voltage supply unit 14_3, respectively.

However, the controller according to the present invention is not limited to this controller 36. It suffices that the controller according to the present invention executes, prior to start of execution of the image forming operation, the lubricant supply operation if the initial determination unit 34 determines that the usage state of the image carrier, that is, the photoreceptor 11 is the state at the initial stage.

An instance in which the controller according to the present invention exercises control after the usage state of the image carrier at the initial stage passes is described.

As stated above, if the usage state of the photoreceptor 11 is the state at the initial stage and in the environment of the low humidity region, the AC voltage, on which the DC voltage is superimposed, is supplied to the lubricant supply brush 31. This makes it possible to stably supply the solid lubricant 32 onto the photoreceptor 11 and to avoid occurrence of the ghost image on each printing sheet. Providing that the usage state of the photoreceptor 11 at the initial stage passes and that the printer 1 is in the environment of the low humidity region, the AC voltage, on which the DC voltage is superimposed, is not supplied to the lubricant supply brush 31. As a result, unless the solid lubricant 32 is supplied onto the photoreceptor 11, the coverage factor of the solid lubricant 32 by which the solid lubricant 32 covers the photoreceptor 11 falls.

Moreover, the fall in the covering factor of the solid lubricant 32 by which the solid lubricant 32 covers the photoreceptor 11 differs between an image forming state and a non-image forming state to be described below.

For example, if the printer 1 is to form an image on one recording sheet of A3 size, the photoreceptor 11 rotates three times according to this exemplary embodiment. It is assumed as follows. At a first rotation of the photoreceptor 11, the printer 1 forms an image in a region of one-third of the recording sheet. At a second rotation of the photoreceptor 11, the printer 1 does not form the image in a region of two-thirds of the recording sheet. At a third rotation of the photoreceptor 11, the printer 1 forms the image in a region of three-thirds of the recording sheet. In this case, in the image forming state at the first and third rotations in which state the photoreceptor 11 holds the developer, the solid lubricant 32 present on the photoreceptor 11 as well as the residual toner is scraped off. Due to this, at the first and third rotations of the photoreceptor 11, the coverage factor of the solid lubricant 32 by which the solid lubricant 32 covers the photoreceptor 11 greatly falls. On the other hand, in the non-image forming state at the second rotation at which state the photoreceptor 11 is operating and the photoreceptor 11 does not hold the developer, the solid lubricant 32 present on the photoreceptor 11 as well as the residual toner is not scraped off. Due to this, at the second rotation of the photoreceptor 11, the fall in the coverage factor of the solid lubricant 32 by which the solid lubricant 32 covers the photoreceptor 11 is small.

Figure 13:
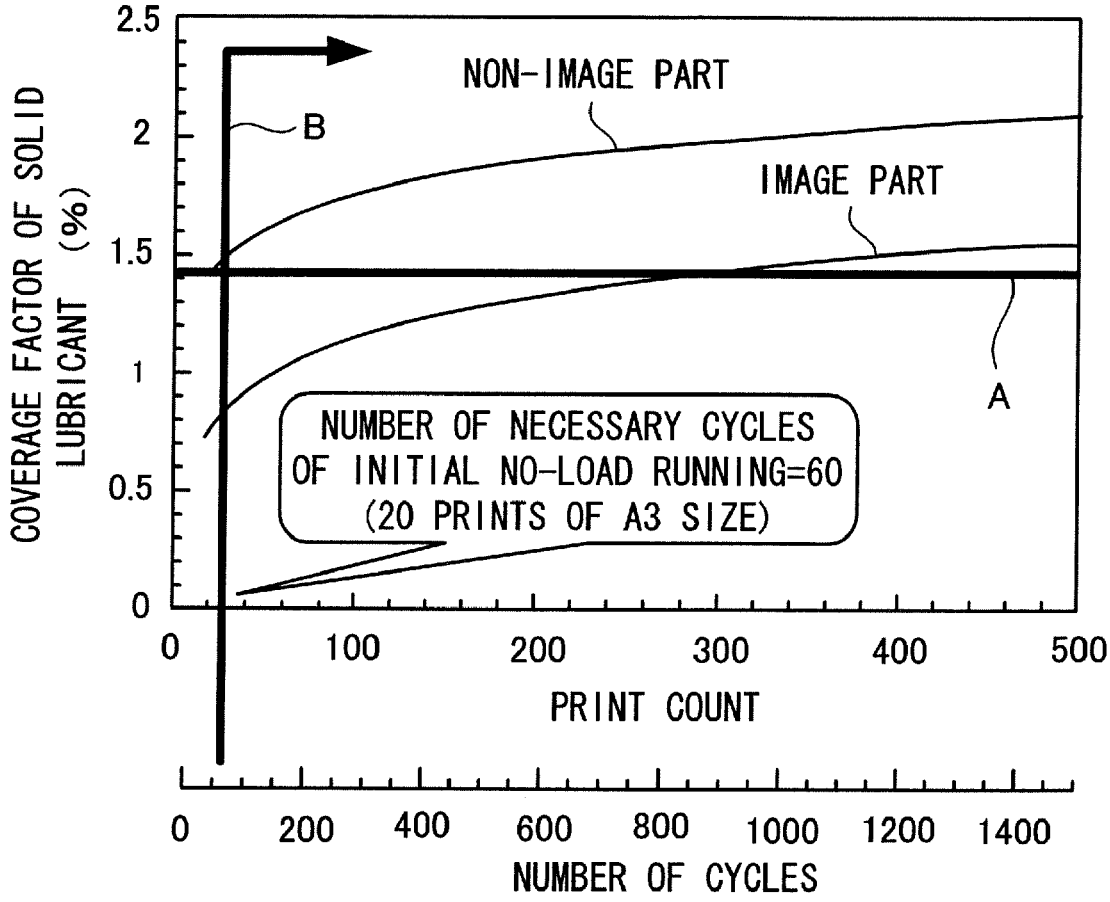
FIG. 13 is a graph showing the relationship between the number of rotation cycles of the photoreceptor and the coverage factor of the solid lubricant by which the solid lubricant covers the photoreceptor in the environment of the low humidity region.

FIG. 13 is a graph showing the relationship between the number of rotation cycles of the photoreceptor 11 and the coverage factor of the solid lubricant 32 by which the solid lubricant 32 covers the photoreceptor 11 in the environment of the low humidity region.

A horizontal axis of FIG. 13 indicates the number of rotation cycles of the photoreceptor 11 and the print count. It is assumed herein that the printer 1 uses the recording sheets of A3 size for printing and that the number of rotation cycles of the photoreceptor 11 is three if the printer 1 prints an image on one recording sheet of A3 size. A vertical axis of FIG. 13 indicates the coverage factor of the solid lubricant 32 by which the solid lubricant 32 covers the photoreceptor 11.

Furthermore, a horizontal line A shown in FIG. 13 indicates a target coverage factor of 1.4%. Namely, if the coverage factor is equal to or higher than 1.4%, the occurrence of the ghost image on the recording sheet is avoided. However, if the coverage factor is lower than 1.4%, the ghost image possibly occurs onto the recording sheet. Moreover, a vertical line B shown in FIG. 13 indicates the coverage factor of the solid lubricant 32 if the printer 1 executes the lubricant supply operation by causing the photoreceptor 11 to make no-load running 60 times (printing images on 20 recording sheets of A3 size) while the photoreceptor 11 is in the state at the initial stage. By executing this operation, the coverage factor is approximately 2.4%.

Further, FIG. 13 shows a graph of an image part of the photoreceptor 11 corresponding to portions of the recording sheet in which portions an image is formed and a graph of a non-image part thereof corresponding to portions of the recording sheet in which portions no image is formed. It is to be noted that the graph of the image part and that of the non-image part are obtained by performing continuous printing in a state of always supplying the AC voltage on which the DC voltage is superimposed to the lubricant supply brush 31 without exercising control for supplying the AC voltage on which the DC voltage is superimposed to the lubricant supply brush 31 if the usage state of the photoreceptor 11 is at the initial stage. As obvious from these graphs, the fall in the coverage factor of the solid lubricant 32 by which the solid lubricant 32 covers the photoreceptor 11 is greater in the image part than in the non-image part since the solid lubricant 32 present on the photoreceptor 11 as well as the residual toner is scraped off in the image part.

Since the AC voltage on which the DC voltage is superimposed is always supplied to the lubricant supply brush 31, a consumption rate of the solid lubricant 32 is high. Furthermore, this voltage applies a heavy stress to the photoreceptor 11 via the lubricant supply brush 31.

Therefore, the controller 36 according to this exemplary embodiment exercises control for supplying the AC voltage, on which the DC voltage is superimposed, to the lubricant supply brush 31 if the usage state of the photoreceptor 11 is the state at the initial stage, and exercises the following control after passing the initial stage. If the initial determination unit 34 determines that the usage state of the photoreceptor 11 at the initial stage passes and the value detected by the environment sensor 35 is in the low humidity region, the controller 36 controls the brush voltage supply unit 33 to supply the AC voltage, on which the DC voltage is superimposed, to the lubricant supply brush 31 in the image forming state and to stop supplying the AC voltage, on which the DC voltage is superimposed, to the lubricant supply brush 31 in the non-image forming state.

The "image forming state" means herein a state in which the photoreceptor 11 holds the developer. More specifically, the "image forming state" corresponds to an instance in which a density of the developer held by the photoreceptor 11 is equal to or higher than 3% (as an example of a threshold value according to the present invention). The "non-image forming state" means herein a state in which the photoreceptor 11 is operating and in which the photoreceptor 11 does not hold the developer. More specifically, the "non-image forming state" corresponds to an instance in which the density of the developer held by the photoreceptor 11 is lower than 3%.

By so controlling, it is possible to suppress the fall in the coverage factor of the solid lubricant 32 in the image part corresponding to the portions of the recording sheet in which portions an image is formed to be small, suppress the consumption rate of the solid lubricant 32 to be low and suppress the stress of the AC voltage, on which the DC voltage is superimposed, applied to the photoreceptor 11 via the lubricant supply brush 31 to be low.

Furthermore, the controller 36 controls the brush voltage supply unit 33 to supply the AC voltage, on which the DC voltage is superimposed, to the lubricant supply brush 31 and controls the photoreceptor 11 to operate at higher speed in the image forming state than in the non-image forming state. In the non-image forming state, the controller 36 controls the brush voltage supply unit 33 to stop supplying the AC voltage, on which the DC voltage is superimposed, to the lubricant supply brush 31 and controls the photoreceptor 11 to operate at lower speed than in the image forming state. By controlling the photoreceptor 11 to operate at higher speed in the image forming state than in the non-image forming state, it is possible to further suppress the stress of the AC voltage, on which the DC voltage is superimposed, applied to the photoreceptor 11 via the lubricant supply brush 31 to be low.

Control over repetition of an image forming state and a non-image forming state in a printer forming color images according to another exemplary embodiment is described.

The printer forming color images includes image forming units corresponding to respective colors of Y (yellow), M (magenta), C (cyan) and K (black). Since a configuration of each of the image forming units is identical to that of the image forming unit of the printer 1 shown in FIG. 1, a configuration of the printer forming color images is not shown.

Figure 14:
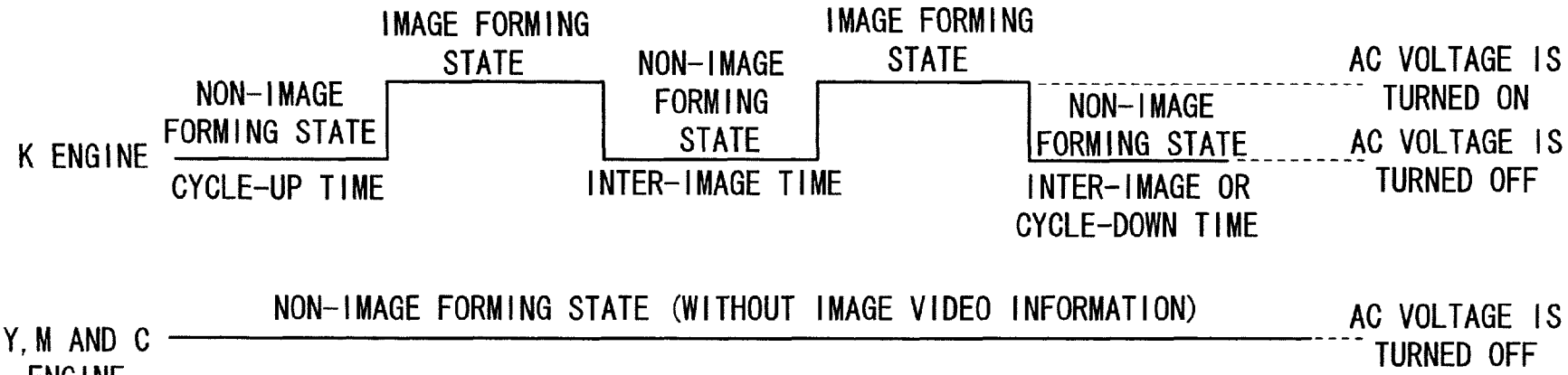
FIG. 14 is a timing chart showing the control over the repetition of the image forming state and the non-image forming state in the printer forming color images.

FIG. 14 is a timing chart showing the control over the repetition of the image forming state and the non-image forming state in the printer forming color images.

An upper part of FIG. 14 shows a timing at which the image forming unit (hereinafter, "K engine") corresponding to the color of K (black) repeats the image forming state and the non-image forming state.

A lower part of FIG. 14 shows a timing at which each of the image forming units (hereinafter, "Y, M and C engines") corresponding to the colors of Y (yellow), M (magenta) and C (cyan), respectively is in the non-image forming state.

It is assumed herein that only the K engine forms a monochrome image using only toner of the color of K (black). Due to this, each of the Y, M and C engines does not hold image video information and is in the non-image forming state. Furthermore, an AC voltage, on which a DC voltage is superimposed and which is to be supplied to a lubricant supply brush included in each of these Y, M and C engines is stopped (turned off).

On the other hand, the K engine is in the non-image forming state at a cycle-up timing at which this printer starts. Furthermore, the AC voltage supplied to a lubricant supply brush included in the K engine is turned off (that is, in an OFF-state). After passage of predetermined time, the K engine turns into the image forming state. In this image forming state, the AC voltage is changed from the OFF-state to an ON-state. Accordingly, the AC voltage is supplied to the lubricant supply brush of the K engine and solid lubricant is supplied to a photoreceptor of the K engine.

Moreover, after passage of the predetermined time, the K engine turns into the non-image forming state (also "inter-image state"). In this non-image forming state, the AC voltage is changed from the ON-state to the OFF-state. Accordingly, supply of the AC voltage to the lubricant supply brush of the K engine is stopped and supply of the solid lubricant to the photoreceptor of the K engine is stopped.

The K engine turns from the non-image forming state into the image forming state and the AC voltage is changed again from the OFF-state to the ON-state. Accordingly, the AC voltage is supplied to the lubricant supply brush of the K engine and the solid lubricant is supplied to the photoreceptor of the K engine.

Furthermore, the K engine turns from the image forming state to the non-image forming state ("inter-image state" or "cycle-down state in which the printer is stopped"). In this state, the AC voltage is changed from the ON-state to the OFF-state. Accordingly, the supply of the AC voltage to the lubricant supply brush of the K engine is stopped and supply of the solid lubricant to the photoreceptor of the K engine is stopped.

In this way, in the printer forming color images according to another exemplary embodiment similarly to the printer 1 shown in FIG. 1, by controlling the AC voltage to be turned on in the image forming state and to be turned off in the non-image forming state, a fall in a coverage factor of the solid lubricant by which the solid lubricant covers the photoreceptor of each of the engines is suppressed to be small and a stress of the AC voltage applied to the photoreceptor of each of the engines via the lubricant supply brush of each of the engines is suppressed to be low.

In the preceding exemplary embodiment, the instance in which the controller 36 controls the brush voltage supply unit 33 to supply the AC voltage, on which the DC voltage is superimposed, to the lubricant supply brush 31 in the image forming state and to stop supplying the AC voltage, on which the DC voltage is superimposed, to the lubricant supply brush 31 in the non-image forming state so as to keep the coverage factor of the solid lubricant 32, by which the solid lubricant 32 covers the photoreceptor 11, to be equal to the coverage factor for avoiding the ghost image generated on each recording sheet is described. Alternatively, the controller 36 may exercise the following control so as to keep the coverage factor for avoiding the ghost image. Oppositely from the control described in the exemplary embodiment, the controller 36 may control the brush voltage supply unit 33 to stop supplying the AC voltage, on which the DC voltage is superimposed, to the lubricant supply brush 31 in the image forming state and to supply the AC voltage, on which the DC voltage is superimposed, to the lubricant supply brush 31 in the non-image forming state. In another alternative, the controller 36 may control the brush voltage supply unit 33 to supply the AC voltage to the lubricant supply brush 31 in a period ranging from a second half of the image forming state to a first half of the non-image forming state, and to stop supplying the AC voltage to the lubricant supply brush 31 in a period ranging from a second half of the non-image forming state to a first half of the image-forming state. Namely, it suffices that the controller according to the present invention controls the first voltage supply unit to repeat the supply of the AC voltage, on which the DC voltage is superimposed, to the lubricant supply brush and the stop of supplying the AC voltage, on which the DC voltage is superimposed, to the lubricant supply brush synchronously with repetition of the image forming state and the non-image forming state if the determination unit determines that the usage state of the image carrier at the initial stage passes.

Furthermore, in the exemplary embodiment, the image forming apparatus according to the present invention is described while taking the printer as an example. The present invention is applicable to a copying machine or any other arbitrary image forming apparatus as long as the image forming apparatus is employed in an electrophotographic device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that holds a developer;

a lubricant supply brush that rotates when in contact with the image carrier, and that supplies a lubricant to a surface of the image carrier;

the lubricant is in contact with the lubricant supply brush;

a first voltage supply unit that supplies an AC voltage on which a DC voltage is superimposed to the lubricant supply brush;

a determination unit that determines whether or not a usage state of the image carrier is a state at an initial stage; and a controller that controls the first voltage supply unit to supply the AC voltage on which the DC voltage is superimposed to the lubricant supply brush, prior to start of execution of an image forming operation if the determination unit determines that the usage state of the image carrier is the state at the initial stage, and wherein, if the determination unit determines that the usage state of the image carrier at the initial stare passes, the controller controls the first voltage supply unit to repeat supply of the AC voltage on which the DC voltage is superimposed to the lubricant supply brush and stop of the supply of the AC voltage to the lubricant supply brush synchronously with repetition of an image forming state and a non-image forming state, the image forming state being a state in which the image carrier is holding the developer, the non-image forming state being a state in which the image carrier is operating and not holding the developer.

2. The image forming apparatus according to claim 1, further comprising:

an environment sensor that detects an environment including a temperature and a humidity, wherein, if the determination unit determines that the usage state of the image carrier is the state at the initial stage and the environment sensor detects a preset environment, the controller controls the first voltage supply unit to supply the AC voltage on which the DC voltage is superimposed to the lubricant supply brush.

3. The image forming apparatus according to claim 1, wherein the first voltage supply unit supplies the AC voltage, on which a DC voltage lower than a discharge start voltage for a discharge generated between the lubricant supply brush and the image carrier is superimposed, to the lubricant supply brush.

4. The image forming apparatus according to claim 1, further comprising:

a charge-elimination unit including a static eliminator arranged upstream of the lubricant supply brush in a rotational direction of the image carrier, and charge-eliminating the image carrier when a second AC voltage on which a second DC voltage is superimposed is supplied to the static eliminator; and a second voltage supply unit that supplies the second AC voltage on which the second DC voltage is superimposed to the static eliminator, wherein, if the controller is to control the first voltage supply unit to supply the AC voltage on which the DC voltage is superimposed to the lubricant supply brush, the controller supplies AC voltages, on which DC voltages identical in a frequency, a phase and a waveform are superimposed, to the first voltage supply unit and the second voltage supply unit, respectively.

5. The image forming apparatus according to claim 4, further comprising:

a developing unit including a developing roll arranged to be proximate to the image carrier, and developing an electrostatic latent image on the image carrier by a toner when a third AC voltage on which a third DC voltage is superimposed is supplied to the developing roll; and a third voltage supply unit that supplies the third AC voltage to the developing roll, wherein the controller controls the first voltage supply unit and the second voltage supply unit to supply the AC voltages, each at a frequency that is a specified fraction of an integer of a frequency of the third AC voltage supplied from the third voltage supply unit to the developing roll, on which DC voltages are superimposed.

6. The image forming apparatus according to claim 1, further comprising:

a charge-elimination unit including a static eliminator arranged upstream of the lubricant supply brush in a rotational direction of the image carrier, and charge-eliminating the image carrier when a second AC voltage on which a second DC voltage is superimposed is supplied to the static eliminator; and a second voltage supply unit that supplies the second AC voltage on which the second DC voltage is superimposed to the static eliminator, wherein, if the controller is to control the first voltage supply unit to supply the AC voltage on which the DC voltage is superimposed to the lubricant supply brush, the controller controls the second voltage supply unit to stop supplying the second AC voltage on which the second DC voltage is superimposed to the static eliminator.

7. The image forming apparatus according to claim 1, further comprising:

an environment sensor detecting an environment including a temperature and a humidity, wherein, if the determination unit determines that the usage state of the image carrier at the initial stage passes and the environment sensor detects a preset environment, the controller controls the first voltage supply unit to repeat the supply and the stop of the supply synchronously with the repetition of the image forming state and the non-image forming state.

8. The image forming apparatus according to claim 1, wherein the image forming state corresponds to an instance in which an image density of the developer held by the image carrier is equal to or higher than a threshold value, and the non-image forming state corresponds to an instance in which the image density of the developer held by the image carrier is lower than the threshold value, and the controller controls the first voltage supply unit to repeat the supply and the stop of the supply synchronously with the repetition of the image forming state and the non-image forming state.

9. The image forming apparatus according to claim 1, wherein, if the determination unit determines that the usage state of the image carrier at the initial stage passes, the controller controls the first voltage supply unit to execute the supply in the image forming state and to stop the supply in the non-image forming state.

10. The image forming apparatus according to claim 9, wherein, if the determination unit determines that the usage state of the image carrier at the initial stage passes, the controller controls the first voltage supply unit to execute the supply and the lubricant supply brush to operate at a high speed relatively to the image carrier in the image forming state, and controls the first voltage supply unit to stop the supply and the lubricant supply brush to operate at a low speed relatively to the image carrier in the non-image forming state.

11. An image forming apparatus including an image carrier that forms a charged image and an electrostatic latent image and that holds a developer when the latent image is developed by the toner while rotating, and executing an image forming operation for fixing a toner image formed on the image carrier onto a recording target medium, comprising:

a lubricant supply brush that rotates when in contact with the image carrier;

a lubricant that is in contact with the lubricant supply brush and that is scraped off by the lubricant supply brush;

a first voltage supply unit that supplies an AC voltage on which a DC voltage is superimposed to the lubricant supply brush;

a determination unit that determines whether or not a usage state of the image carrier is a state at an initial stage; and a controller that controls the image forming apparatus to execute a lubricant supply operation for supplying the lubricant to the image carrier while controlling the first voltage supply unit to supply the AC voltage to the lubricant supply brush, prior to start of execution of the image forming operation if the determination unit determines that the usage state of the image carrier is the state at the initial stage, and wherein, if the determination unit determines that the usage state of the image carrier at the initial stare passes, the controller controls the first voltage supply unit to repeat supply of the AC voltage on which the DC voltage is superimposed to the lubricant supply brush and stop of the supply of the AC voltage to the lubricant supply brush synchronously with repetition of an image forming state and a non-image forming state, the image forming state being a state in which the image carrier is holding the developer, the non-image forming state being a state in which the image carrier is operating and not holding the developer.

12. An image forming apparatus including an image carrier that forms a charged image and an electrostatic latent image and that holds a developer when the electrostatic latent image is developed by the toner while rotating, and executing an image forming operation for fixing a toner image formed on the image carrier onto a recording target medium, comprising:

a lubricant supply brush that rotates when in contact with the image carrier;

a lubricant that is in contact with the lubricant supply brush and that is scraped off by the lubricant supply brush;

a first voltage supply unit that supplies an AC voltage on which a DC voltage is superimposed to the lubricant supply brush;

a determination unit that determines whether or not a usage state of the image carrier is a state at an initial stage; and a controller that raises number of rotations of the lubricant supply brush as compared with ordinary image formation during execution of a lubricant supply operation for supplying the lubricant to the image carrier while controlling the first voltage supply unit to supply the AC voltage on which the DC voltage is superimposed to the lubricant supply brush, prior to start of execution of the image forming operation if the determination unit determines that the usage state of the image carrier is the state at the initial stage, and wherein, if the determination unit determines that the usage state of the image carrier at the initial stare passes, the controller controls the first voltage supply unit to repeat supply of the AC voltage on which the DC voltage is superimposed to the lubricant supply brush and stop of the supply of the AC voltage to the lubricant supply brush synchronously with repetition of an image forming state and a non-image forming state, the image forming state being a state in which the image carrier is holding the developer, the non-image forming state being a state in which the image carrier is operating and not holding the developer.

* * * * *